United States Patent [19]

Kurachi et al.

[11] Patent Number: 4,701,579

[45] Date of Patent: Oct. 20, 1987

[54] DATA ENTRY KEYBOARD

[75] Inventors: Hisao Kurachi, Okazaki; Kazuyoshi Minaminaka, Suzuka; Takeo Ito, Kuwana; Kiyoshi Yamakawa, Gifu, all of Japan

[73] Assignee: Brother Kogyo Kabushiki Kaisha, Nagoya, Japan

[21] Appl. No.: 868,426

[22] Filed: May 28, 1986

[30] Foreign Application Priority Data

May 29, 1985 [JP] Japan ..... 60-81442[U]

[51] Int. Cl.[4] ..... H01H 13/70

[52] U.S. Cl. ..... 200/5 A; 200/159 B

[58] Field of Search ..... 200/5 A, 86 R, 159 B

[56] References Cited

U.S. PATENT DOCUMENTS

| | | | |
|---|---|---|---|
| 4,220,815 | 9/1980 | Gibson et al. | 200/86 R X |
| 4,317,013 | 2/1982 | Larson | 200/159 B X |
| 4,324,962 | 4/1982 | Dulen | 200/159 B |
| 4,391,845 | 7/1983 | Denley | 200/159 B X |
| 4,415,780 | 11/1983 | Daugherty et al. | 200/5 A |
| 4,472,609 | 9/1984 | Lamm et al. | 200/5 A |
| 4,605,828 | 8/1986 | Gostomski, Jr. et al. | 200/159 B X |

*Primary Examiner*—J. R. Scott

*Attorney, Agent, or Firm*—Jordan B. Bierman

[57] ABSTRACT

Disclosed is a data entry keyboard which has a multitude of depressible keys which are selectively depressed for the entry of predetermined data. In the keyboard, an insulating member is sandwiched between a first substrate having stationary electrodes and a flexible second substrate having movable electrodes. The stationary and movable electrodes face one another through apertures formed in the insulating member. Upper and lower marginal surface portions of the insulating member, including the respective peripheral edges of the apertures, are kept parallel to the first and second substrates corresponding thereto by a plurality of protuberances on the substrates so that voids with a predetermined width are left between the marginal surface portions and the individual substrates. The movable electrodes of the second substrate are electrically fixed, in the form of a cantilever each, to the extreme end portions of branch conductor strips which diverge from a main conductor strip at right angles thereto. When one of the keys is depressed, the second substrate is deformed to narrow the corresponding void, thus bringing the corresponding movable and stationary electrodes into contact with each other.

4 Claims, 12 Drawing Figures

DATA ENTRY KEYBOARD

BACKGROUND OF THE INVENTION

The present invention relates to a data entry device which is connected to an electronic typewriter, electronic computer or other electronic equipment for the entry of predetermined data thereon, and more specifically to a flexible data entry keyboard having a multitude of keys, in which stationary electrodes and movable electrodes, corresponding to the individual keys, are provided on a first substrate and a flexible second substrate, respectively, so that the stationary and movable electrodes face one another through apertures in an insulating member interposed between the two substrates, whereby, upon depression of any of the keys, the flexible second substrate is deformed to bring the movable electrode corresponding to the depressed key into contact with its corresponding stationary electrode for switch activation.

A conventional keyboard of this type generally comprises a multitude of keys 55, a switch substrate assembly 61, and an elastic member formed with cup-shaped portions 63. As shown in FIG. 1, each of the keys 55 is formed of a frame 51 and a key stem 53 supported thereby for vertical slide. Movable electrodes 57 and stationary electrodes 59, each constituting a keyswitch, are arranged in the switch substrate assembly 61 in predetermined patterns corresponding to the individual keys 55. The cup-shaped portions 63, having a tactile feedback effect, individually support operating plates **53*a* which are arranged corresponding to the individual keys 55 and constitute part of the key stem 53 each. The switch substrate assembly 61 includes a first substrate 67, a flexible, filmy second substrate 71, and an insulating member 73 sandwiched between the first and second substrates 67 and 71. The first substrate 67 carries thereon the stationary electrodes 59 corresponding to the keys 55 and conductors 65 connecting the stationary electrodes 59. The stationary electrodes 59 and the conductors 65 are arranged in predetermined patterns. As shown in FIG. 2, the second substrate 71 is provided with the movable electrodes 57 corresponding to the stationary electrodes 59 and conductors 69 which extend straight from side to side past the centers of their corresponding movable electrodes 57, thereby connecting the electrodes 57. The insulating member 73 is formed with a number of apertures 73*a* which correspond in position to the stationary and movable electrodes 59 and 57 and through which the electrodes 59 and 57** are in contact with one another.

When one of the keys 55 is depressed against the resilience of its corresponding cup-shaped portion 63 of the elastic member, a pressure portion **63*a*, which is formed on the inner surface of the top wall of the cup-shaped portion 63, is downwardly pressed against that portion of the second substrate 71 which overlies the corresponding movable electrode 57. As the second substrate 71 is bent in this manner, the movable electrode 57 is brought into contact with the stationary electrode 59 to turn the keyswitch on. Thus, predetermined input data corresponding to the depressed key 55** is entered.

One such prior art keyboard is disclosed in, for example, U.S. Pat. No. 4,354,068.

The assignee hereof has previously proposed, in U.S. Pat. No. 4,528,428, a keyboard of this type which is provided with a curved operating surface of keys.

In the keyboard described above, however, when the key 55 is depressed as indicated by an arrow in FIG. 3, the conductors 69, which extend straight past the center of their corresponding movable electrode 57, must be bent, together with the second substrate 71, on both sides of the peripheral edge of the aperture **73*a*. Accordingly, the key 55 must be operated with a large force for a long stroke before the movable electrode 57 is brought into contact with the stationary electrode 59 to turn the keyswitch on, as shown in FIG. 4**. Thus, it is difficult to activate the keyswitches securely and lightly, and the predetermined data cannot be entered with reliability.

These problems are attributed to the following situations or factors. First, the conductors 69, which are electrically connected to each movable electrode 57 on the flexible second substrate 71, extend on both sides of the electrode 57. When the electrode 57 is depressed in its corresponding aperture **73*a* upon depression of its corresponding key, it is supported by the conductors 69** on both sides thereof.

Thus, the rigidity of the conductors 69, which are formed of patterns of silver or other material printed on the flexible substrate 71, constitutes a nonnegligible hindrance to the lightness of key depression.

Secondly, the first and second substrates 67 and 71, especially the flexible second one, is closely in contact with the insulating member 73, covering the peripheral edges of the apertures **73*a*. When the flexible substrate 71 is deformed by key depression, therefore, it is subjected to a substantial resistance due to friction with the insulating member 73**.

These factors, when put together, have a bad influence upon the flexibility of the second substrate 71 to be deformed, thus requiring an increased key force for the activation of the keyswitches. Accordingly, the pressure portion **63*a* of the cup-shaped portion 63, directly touched by the flexible substrate 71, would be subjected to an increased upward reaction force from the substrate 71 at the time of key depression. Thus, a longer travel or stroke of keys 55** is required for the activation of the keyswitches.

SUMMARY OF THE INVENTION

The object of the present invention is to provide a data entry keyboard which can settle the aforementioned problems of the prior art keyboards, ensuring a light, reliable key depression with a smaller key force and reduced key travel or stroke, thus permitting high-reliability data entry.

In order to achieve the above object, according to the present invention, conductor means electrically connected to movable electrodes on a flexible second electrode includes an elongate main conductor strip and branch conductor strips diverging therefrom. Each of the movable electrodes is connected to the extreme end of its corresponding branch conductor strip in the form of a cantilever. According to the invention, moreover, spacer means are provided which define voids between the second substrate and at least those upper marginal surface portions of an insulating member, including the respective peripheral edges of apertures in the insulating member, which face the second substrate. Thus, the second substrate and each of the marginal surface portions of the insulating member are spaced parallel to each other with a gap of a predetermined width between them.

In the fundamental arrangement of the invention described above, the movable electrode is depressed in the form of a cantilever by its corresponding key. Accordingly, the conductor means is much lower in rigidity than conventional conductor means which are supported at both ends. Moreover, the voids are formed between the insulating member and the flexible second substrate, surrounding the apertures. When deformed by key depression, therefore, the substrate is subjected to a smaller resisting force by friction with the peripheral edge portions of the apertures of the insulating member.

Thus, the key depression is very light, so that the key force and key travel or stroke required for the activation of keyswitches can be reduced.

The spacer means can readily be formed by studding the flexible second substrate with protuberances around the movable electrodes.

Preferably, the spacer means should also be provided between the first substrate and the lower marginal surface portions of the peripheral edges of the apertures in the insulating member. By doing this, the peripheral edge portions of the insulating member can also be deformed with ease by key depression, permitting lighter key operation. Preferably, these spacer means are also formed of protuberances which are arranged on the first substrate, surrounding the stationary electrodes and corresponding in position to the protuberances on the second substrate. Thus, the insulating member is securely held by the upper and lower protuberances, and the upper and lower voids can maintain their predetermined uniform width between the first and second substrates.

Preferably, moreover, the branch conductor strips, connected at their extreme end portions with the movable electrodes, are arranged substantially at right angles to the elongate main conductor strip and parallel to one another. This arrangement facilitates a pattern layout such that a multitude of movable electrodes are connected to the conductor means in the cantilevered manner as aforesaid.

BRIEF DESCRIPTION OF THE DRAWINGS

The above and other objects, features and advantages of the present invention will be better understood from the following description of the preferred embodiment thereof which is to be read in connection with the accompanying drawings, in which.

DETAILED DESCRIPTION OF THE PREFERRED EMBODIMENT

Referring to FIGS. 5 to 12, there is shown a data entry keyboard according to a preferred embodiment of the present invention.

Figure 5:
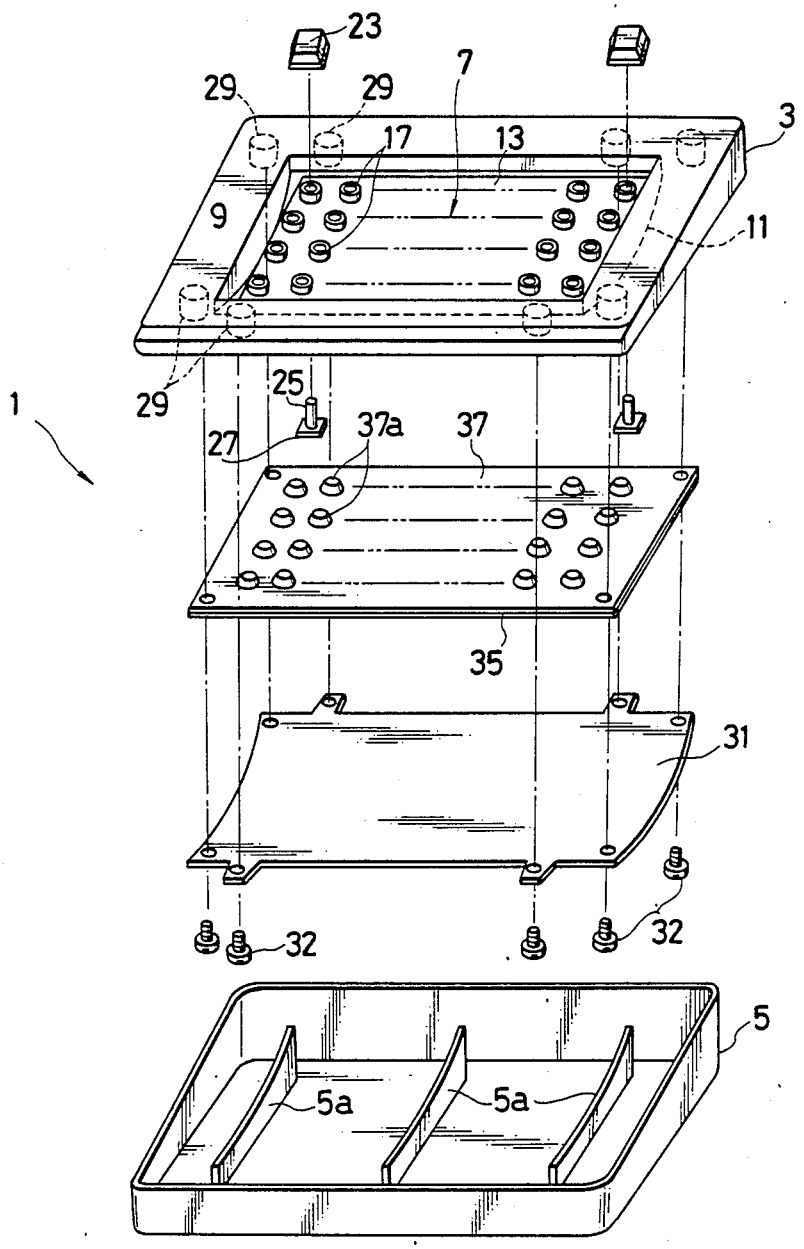
FIG. 5 is an exploded perspective view of a keyboard according to an embodiment of the present invention.
Figure 6:
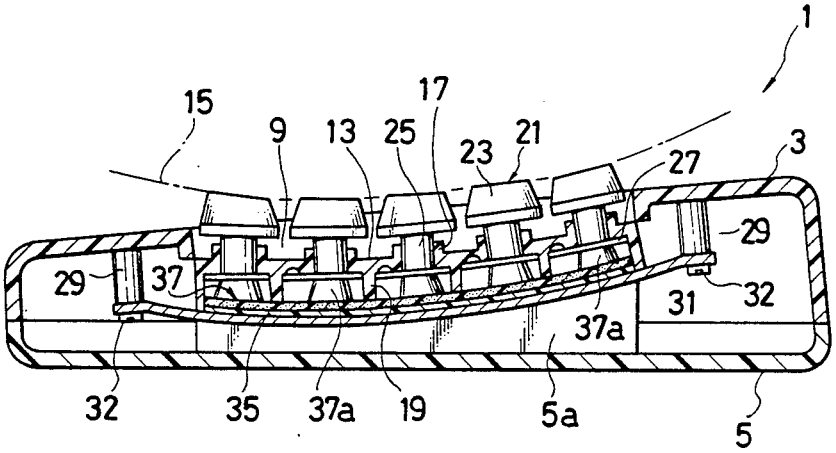
FIG. 6 is a cross-sectional view of the keyboard of FIG. 5 in an assembled state.

In the exploded perspective view of FIG. 5 and the sectional view of FIG. 6, an assembly of a keyboard 1, which constitutes a data entry device according to the invention, comprises upper and lower casings 3 and 5, both formed of synthetic resin. An opening 7 is bored through a planar portion of the upper casing 3. Downwardly convex pendent lugs 9 and 11 are formed on the left and right side edges of the opening 7, respectively. A key holder plate 13 is formed integrally on the central portions of the lower ends of the pendent lugs 9 and 11. After it is molded into a flat structure, the key holder plate 13 is shaped so that a curved operating surface 15 with a predetermined curvature is defined by the top faces of keys 21 (mentioned later), as shown in FIG. 6. The key holder plate 13 is formed integrally with a number of stem guides 17. Each stem guide 17 supports a key stem 25 which, in cooperation with a key top 23, constitutes the key 21 so that the key stem 25 can slide vertically. A number of partition plates 19 are formed integrally on the undersurface of the key holder plate 13, corresponding to the individual stem guides 17. An operating plate 27, constituting part of the key stem 25, is supported by each partition plate 19 for vertical motion.

The key top 23, which is adapted to be depressed by an operator, is formed integrally with the operating plate 27.

Bosses 29 are formed integrally on the inner surface of the upper casing 3. A rigid metallic regulating plate 31 is fixed to the bosses 29 by means of screws 32. The regulating plate 31 is previously subjected to plastic deformation such that it forms a curved surface with a predetermined curvature corresponding to the operating surface 15.

A switch substrate assembly 35 (described in detail later) is mounted on the upper surface of the regulating plate 31. The switch substrate assembly 35 is kept curved by the regulating plate 31 so that its curvature is substantially equal to that of the regulating plate 31.

A sheetlike elastic member 37 is bonded to the upper surface of the switch substrate assembly 35. A number of cup-shaped portions **37*a* are arranged on the elastic member 37, corresponding to the individual keys 21. The operating plates 27 are supported on the top surface of the elastic member 37. Thus, the cup-shaped portions 37*a* of the elastic member 37 urge the operating plates 27 upward (FIG. 2) by its resiliency, so that the keys 21 are normally kept nondepressed. A pressure portion 37*b* is formed on the inner surface of the top wall of each cup-shaped portion 37*a* of the elastic member 37, facing each corresponding movable electrode 41*b* which will be mentioned later. The pressure portion 37***b* has a shape similar to that of the pressure portion 63*a* of the prior art keyboard shown in FIG. 1. Like the elastic member 63 shown in FIG. 1, the elastic member 37 has a tactile feedback effect.

As shown in FIG. 5, a plurality of support portions 5*a* are formed integrally on the bottom surface of the lower casing 5, extending at right angles to the longitudinal direction of the lower casing 5. Each support portion 5*a* has a curved top surface corresponding in shape to the operating surface 15. The regulating plate 31 is placed on the support portions 5*a*. Thus, the regulating plate 31 is kept curved in conformity with the operating surface 15. An arrangement similar to the frame structure of the keyboard described above is stated in U.S. Pat. No. 4,528,428 filed by the assignee hereof. Therefore, the keyboard frame structure itself does not constitute the essential point of the present invention.

Figure 7:
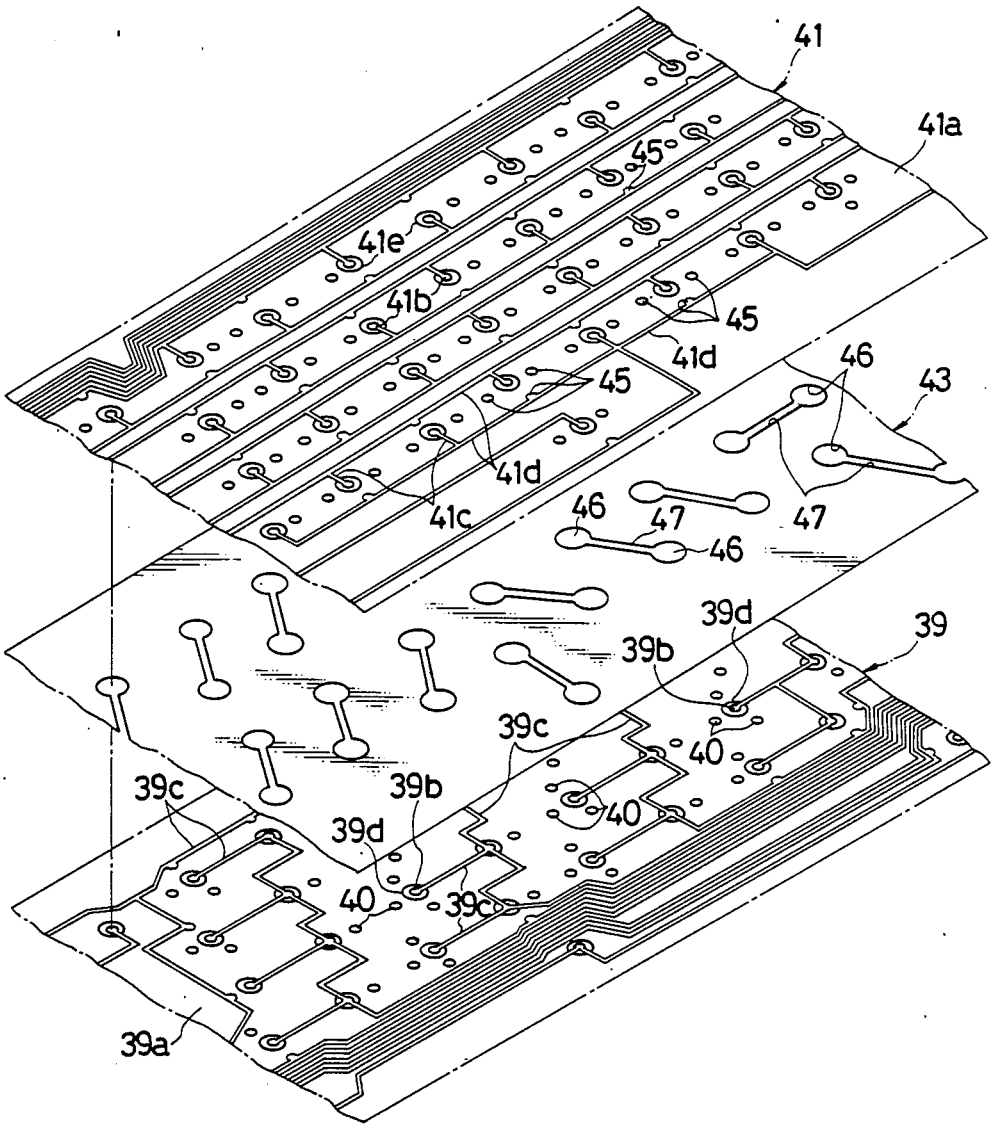
FIG. 7 is an exploded, enlarged perspective view of the keyboard of the invention.
Figure 8:
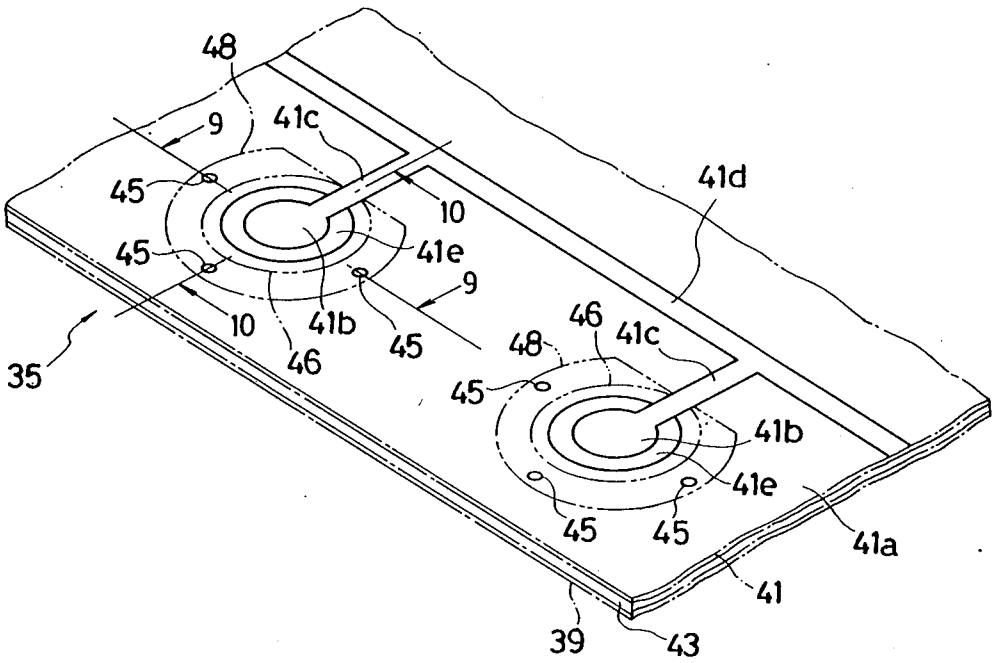
FIG. 8 is an enlarged perspective view showing the principal part of a substrate assembly shown in FIG. 7.
Figure 9:
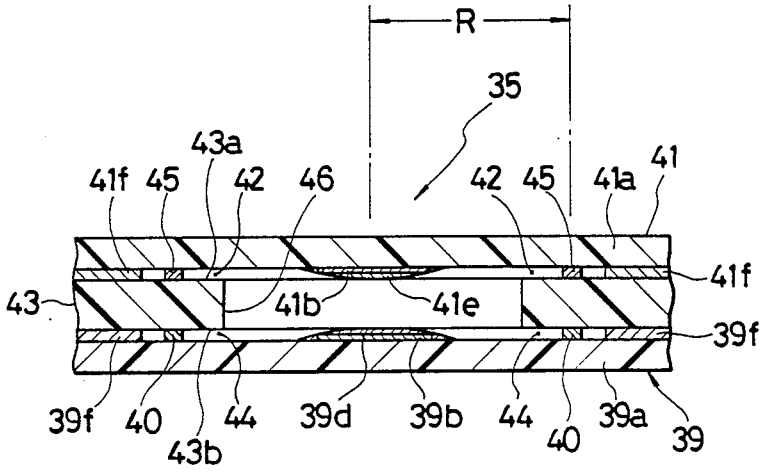
FIG. 9 is a partial, enlarged sectional view taken along line 9—9 of FIG. 8.
Figure 10:
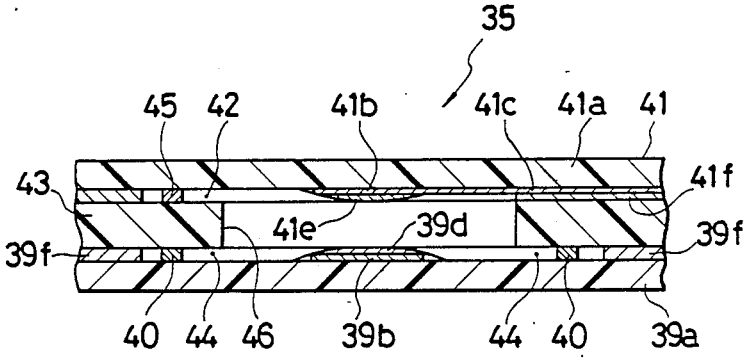
FIG. 10 is a partial, enlarged sectional view taken along line 10—10 of FIG. 8.

FIG. 7 is an exploded view of the switch substrate assembly 35, FIG. 8 is an enlarged view showing switch portions of the switch substrate assembly 35, and FIGS. 9 and 10 are enlarged sectional views taken along lines 9—9 and 10—10, respectively, of FIG. 8. Referring to these drawings, the switch substrate assembly 35 comprises a first or lower filmy substrate 39, a flexible second or upper filmy substrate 41, and a filmy insulating member 43 sandwiched between the first and second substrates 39 and 41. The first substrate 39 includes a first filmy membrane sheet 39*a* having flexibility and insulating property, stationary electrodes 39*b* facing the cup-shaped portions 37*a* of the elastic member 37, and conductors 39*c* as conductor means electrically connecting the stationary electrodes 39*b*. The electrodes 39*b* and conductors 39*c* are silver patterns of a predetermined thickness formed on the upper surface of the first membrane sheet 39*a* by printed wiring. A circular carbon layer 39*d* of a predetermined thickness is formed on each stationary electrode 39*b* so as to cover the same. A resist layer 39*f* of a predetermined thickness is formed on the conductors 39*c*, leaving the stationary electrodes 39*b* and carbon layers 39*d* uncovered.

The first membrane sheet 39*a* is formed with a plurality of protuberances 40 as spacer means, each three of which are arranged at angular intervals of 90 degrees along the circumference of a circle around each corresponding stationary electrode 39*b*, in a manner such that the protuberances 40 do not interfere with the conductors 39*c*. The protuberances 40 have a height equal to the thickness of the conductors 39*c* and resist layer 39*f*. Each three protuberances 40 define a small void 44 between the first membrane sheet 39*a* and the lower surface of the insulating member 43 so that their corresponding stationary electrode 39*b* is surrounded by the void 44. Inside circular regions, which are a little greater in diameter than the arrangement circles of the protuberances 40, the resist layer 39*f* is not on the membrane sheet 39*a*.

The flexible second substrate 41 includes a second filmy membrane sheet 41*a* having flexibility and insulating property, movable electrodes 41*b* facing the stationary electrodes 39*b*, and conductors 41*c* and 41*d* as conductor means electrically connecting the movable electrodes 41*b*. The electrodes 41b and conductors 41*c* and 41*d* are silver patterns of a predetermined thickness formed on the lower surface of the second membrane sheet 41*a* by printed wiring. A circular carbon layer 41*e* of a predetermined thickness is formed on each movable electrode 39*b* so as to cover the same. A resist layer 41*f* of a predetermined thickness is formed on the conductors 41*c* and 41*d*, leaving the movable electrodes 41*b* and carbon layers 41*e* uncovered.

The second membrane sheet 41*a* is formed with a plurality of protuberances 45 as spacer means, each three of which are arranged at angular intervals of 90 degrees along the circumference of a circle around each corresponding movable electrode 41*b*, in a manner such that the protuberances 45 do not interfere with the conductors 41*c*, as seen from FIG. 8. The protuberances 45 face their corresponding lower protuberances 40, and have a height equal to the thickness of the conductors 41*c* and 41*d*and resist layer 41*f*. Each three protuberances 45 define a small void 42 between the second membrane sheet 41*a* and the upper surface of the insulating member 43 so that their corresponding movable electrode 41*b* is surrounded by the void 42. The protuberances 40 and 45, which are made of the same metal material of the conductors 39*c*, 41*c* and 41*d*, are formed on their corresponding substrates 39 and 41 by pattern-printing. As shown in FIG. 7, some of the protuberances 45 may be formed integrally with the conductors 41*d*.

The insulating member 43 is formed of a flexible insulating film, and a multitude of circular apertures 46 are bored through the insulating member 43, corresponding in position to the stationary and movable electrodes 39*b* and 41*b*. As shown in FIG. 7, the insulating member 43 is formed with communication slits 47 which connect each pair of adjacent apertures 46. Each communication slit 47 serves as a passage through which air in the aperture 46 corresponding to a selected one of the keys 21 escapes into the adjacent aperture 46 when the key 21 is depressed to bend the second membrane sheet 41*a*downward.

In order to form the voids 42 by means of the protuberances 45 of the spacer means, as shown in FIG. 8, the resist layer 41*f* is not present within substantially circular regions 48 whose peripheral edges are located radially outside those of the arrangement circles of their corresponding protuberances 45 by a narrow margin.

Thus, the voids 42, which are substantially parallel except for the portions covered by the conductors 41*c*, are secured between the flexible second substrate 41 and ring-shaped upper marginal surface portions 43*a* of the insulating member 43 including peripheral edges defining the apertures 46.

Likewise, voids 44 are secured between the first substrate 39 and ring-shaped lower marginal surface portions 43*b* of the insulating member 43.

Figure 2:
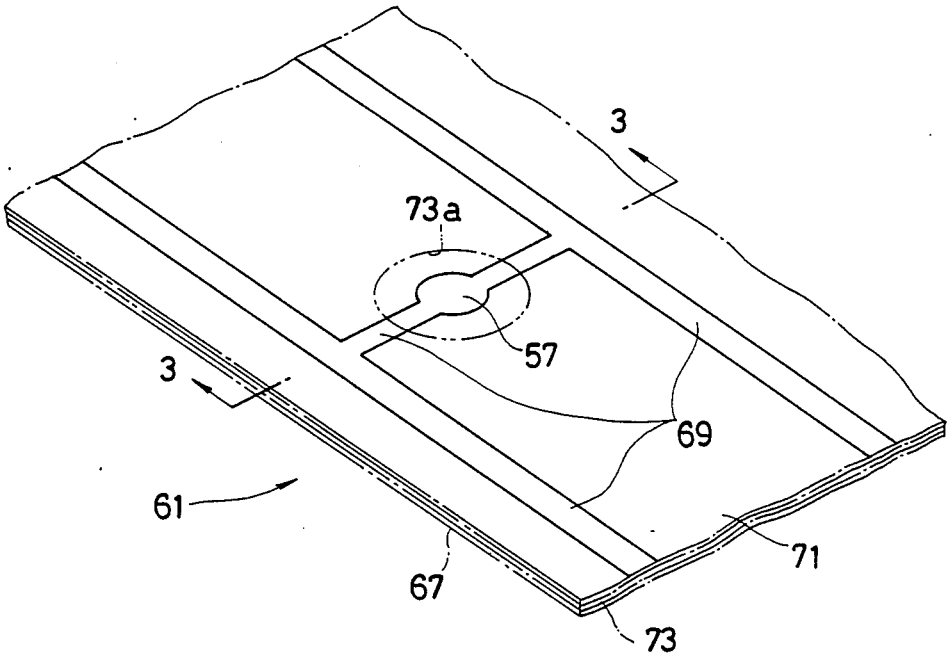
FIG. 2 PRIOR ART
FIG. 2 is a partial perspective view of a substrate assembly of the keyboard of FIG. 1.
Figure 3:
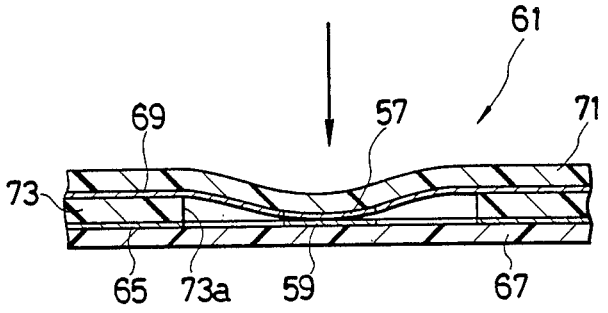
FIG. 3 PRIOR ART
FIG. 3 is a partial sectional view of the substrate assembly taken along line 3—3 of FIG. 2, showing a state that the assembly is deformed by key depression.
Figure 4:
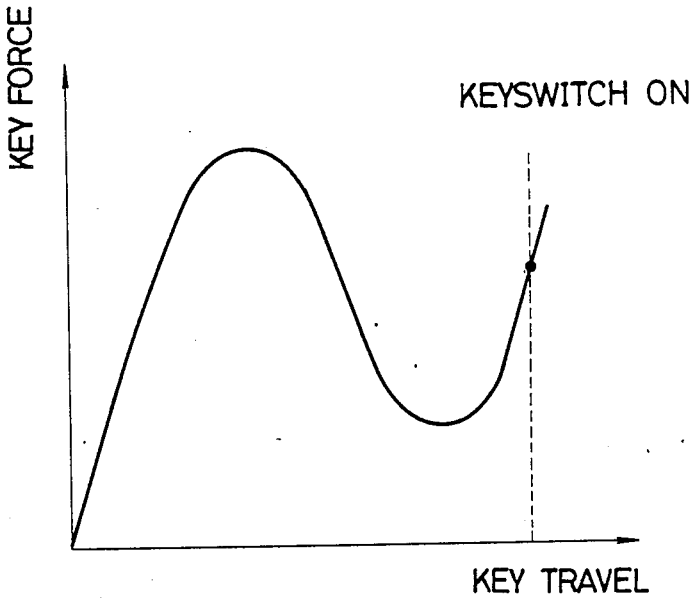
FIG. 4 PRIOR ART
FIG. 4 is a graph showing the relationship between key force and key travel obtained as a result of key depression on the keyboard of FIG. 1.

Among the conductors 41*c* and 41*d* constituting the conductor means of the flexible second substrate 41, as shown in FIG. 8, the conductor 41*d* is formed of an elongate main conductor strip extending straight on the substrate 41, while the conductors 41*c* are arranged as branch conductor strips diverging at right angles from the strip 41*d* and extending parallel to one another. The extreme end portion of each branch conductor strip 41*c* extends to its corresponding aperture 46, where it is connected with one of the movable electrodes 41*b* in the form of a cantilever. Thus, the arrangement of the movable electrodes 41*b* according to the present invention, is different from the prior art arrangement in which the conductors extend on both sides of each movable electrode, as shown in FIG. 2.

Figure 11:
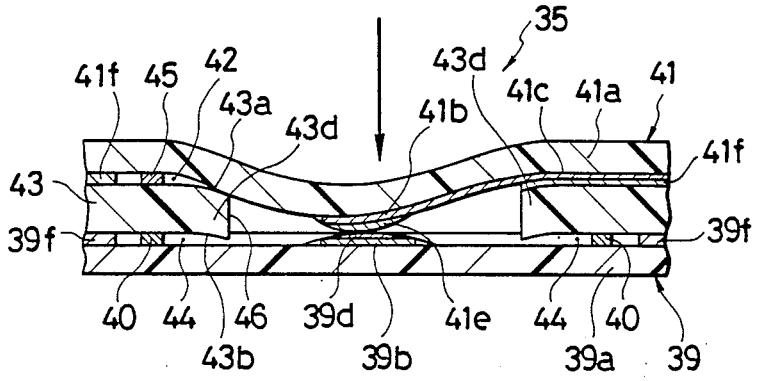
FIG. 11 a sectional view, similar to FIG. 10, illustrating an operating state of the substrate assembly at time of key depression.

Referring now to FIG. 11, the operation of the keyboard 1 of the above-mentioned construction, based on key depression, will be described.

In FIG. 11, the stationary and movable electrodes 39*b*and 41*b* are in contact with each other so that the keyswitch is on. If the key top 23 (FIG. 6) of the key 21 is pressed down, as indicated by an arrow in FIG. 11, the key stem 25 moves down, guided by the stem guide 17, so that the operating plate 27 presses the cup-shaped portion 37*a*. As a result, the cup-shaped portion 37*a* is compressed against its resilience so that the pressure portion 37*b* is pressed against that portion of the second membrane sheet 41*a* corresponding to the movable electrode 41*b*. Thus, the second membrane sheet 41*a* is curved down corresponding to the movable electrode 41*b*. Thus, the second membrane sheet 41*a* is curved downward to bring the movable electrode 41*b* into contact with its corresponding stationary electrode 39*b* through the aperture 46, as shown in FIG. 11. The movable electrode 41*b* is coupled to one of the branch conductor strips 41*c* in the form of a cantilever, and the voids 42 and 44 are defined between the second membrane sheet 41*a* and the insulating member 43 and between the first membrane sheet 39*a* and the insulating member 43 by the protuberances 45 and 40, respectively. Accordingly, the second membrane sheet 41, along with the movable electrode 41*b* and the cantilevered conductor 41*c*, is smoothly deformed without being frictionally resisted by the peripheral edge portion of the aperture 46. Since a peripheral edge portion 43*d* of the insulating member 43 is also supported in the form of a cantilever by the upper and lower protuberances 40 and 45, it is easily deformed downward as illustrated when it is touched by the deformed second membrane sheet 41*a*. Thus, the key 21 can be depressed lightly.

As described before, the insulating member 43 is formed with the communication slits 47 each connecting a pair of apertures 46. When the second membrane sheet 41*a* is bent downward in the aperture 46 upon depression of the key 21, therefore, air in the aperture 46 can escape into the adjacent aperture 46 via the communication slit 47. With this arrangement, compressive resistance, which is produced when air is compressed as the second membrane sheet 41*a* is bent, can be reduced so that the movable electrode 41*b* can be brought into contact with the stationary electrode 39*b* with a small key force.

When the key top 23 is released, the key stem 25 is pushed up by the restoring force of the cup-shaped portion 37*a* through the medium of the operating plate 27. Thus, the second membrane sheet 41*a* is released from the press by the pressure portion 37*b*. As a result, the movable electrode 41*b* is separated from the stationary electrode 39*b* by the resilience of the second membrane sheet 41*a*. Since the protuberances 40 and 45 are arranged around the stationary and movable electrodes 39*b* and 41*b*, respectively, the restoring force of the second membrane sheet 41*a* is great, and the first and second membrane sheets 39*a* and 41*a* are separated to resume their parallel relation. Thus, the stationary and movable electrodes 39*b* and 41*b* are securely restored to a noncontact state with speed.

Figure 1:
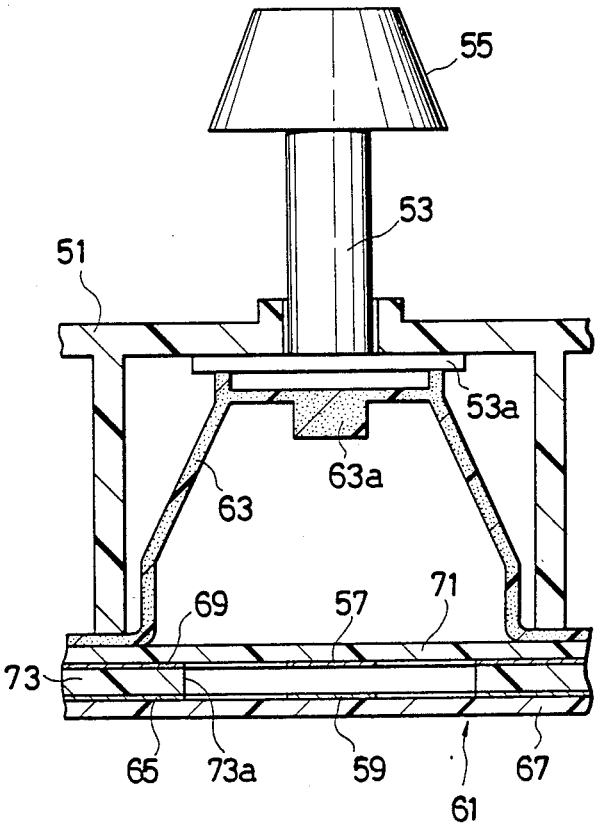
FIG. 1 PRIOR ART
FIG. 1 is a vertical sectional view showing the principal part of a prior art keyboard.
Figure 12:
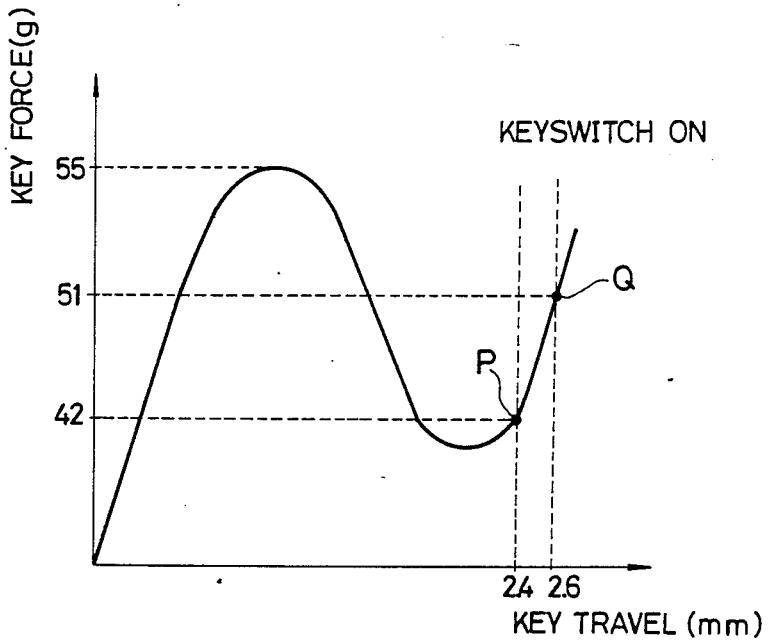
FIG. 12 is a graph showing the relationship between key force and key travel obtained as a result of key depression on the keyboard of the invention as compared with the case of the prior art keyboard.

In the graph of FIG. 12, the relationship between key force and key travel according to the present invention is compared with that of the conventional arrangement shown in FIG. 1 under the following conditions. The keyswitch is turned on at point P in the case of the invention and at point Q in the prior art case.

Thickness of membrane of second substrate: 0.075 mm.

Thickness of silver pattern film of conductors: 0.01 mm.

Diameter of apertures of insulating member: 8 mm.

In the present invention, distance R (FIG. 9) from the point of action of the key 21, i.e., the center of the movable electrode 41*b* to each protuberance 45 is 5 mm.

As seen from the graph of FIG. 12, the key force required for the activation of the keyswitch according to the invention is lighter than that of the prior art case by 9 g, and the key travel or stroke is shorter by 0.2 mm.

It is to be understood from the above description that the necessary key force is greatly reduced according to the present invention. The key stroke is shortened because the reduction of the key force results in a reduction of the reaction force of the substrate assembly 35 acting on the elastic member 37 (FIG. 6) and hence of the degree of compression of the member 37.

Thus, according to the present invention, the key force is reduced to permit light and quick key operation, and the key stroke is shortened for more reliable key entry.

In the embodiment described herein, the protuberances 40 and 45 as spacer means are arranged under and over the insulating member 43, respectively. In some cases, however, only the upper protuberances 45 may be provided to define the voids 42 only between the insulating member 43 and the second substrate 41, with the same result.

The spacer means may be formed of a ring-shaped structure surrounding each of the electrodes 39*b* and 4*b*. besides such protuberances as are used in the above described embodiment. The configuration of the spacer means is not limited to the embodiment, and may be changed or modified variously.

What is claimed is:

1. A data engry keyboard having a multitude of depressible keys which are selectively depressed for the entry of predetermined data, comprising:

a first substrate including stationary electrodes corresponding individually to the keys;

a flexible second substrate deformable by the depression of the keys and including movable electrodes corresponding individually to the stationary electrodes and conductor means electrically connected to the individual movable electrodes, each said conductor means being formed of an elongated main conductor strip and branch conductor strips extending from the main conductor strip and connected, at one end portion thereof, to their corresponding movable electrodes in the form of a cantilever;

an insulating member interposed between the first and second substrates and having a multitude of apertures in alignment with the stationary and movable electrodes, each said aperture having a peripheral edge provided with a first predetermined diameter, said insulating member including first ring-shaped marginal surface portions corresponding to the first substrate and second ring-shaped marginal surface portions corresponding to the second substrate, both said first and second ring-shaped marginal surface portions surrounding the respective peripheral edges of the apertures;

first spacer means located radially outside the peripheral edge of said aperture along a first circle provided with a second predetermined diameter larger than said first diameter so as to define a first void of a predetermined width between the second substrate and the second marginal surface second spacer means located radially outside the peripheral edge of said aperture along a second circle provided with said second predetermined diameter so as to define a second void of a predetermined width between the first substrate and the first marginal surface portion, whereby said insulating member is supported at the peripheral edge portion of the aperture by said first and second spacer means in the form of a cantilever.

2. The data entry keyboard according to claim 1 wherein said first spacer means includes a plurality of first protuberances which are formed on the second substrate and arranged at given angular intervals along said first circle, and said second spacer means includes a plurality of second protuberances which are formed on the first substrate and arranged so that said second protuberances correspond to face said first protuberances respectively.

3. The data entry keyboard according to claim 2 wherein said first protuberances are three in number and arranged at angular intervals of 90 degrees.

4. The data entry keyboard according to claim 1, wheein said branch conductor strips extend substantially at right angles to the main conductor strip and parallel to one another.

* * * * *